US007215333B2

(12) United States Patent
Chen et al.

(10) Patent No.: US 7,215,333 B2
(45) Date of Patent: May 8, 2007

(54) METHOD FOR DRIVING LCD DEVICE

(75) Inventors: Chen-Jung Chen, Chu-Nan County (TW); Yuhren Shen, Tai-Nan (TW); Liang-Chen Chien, Chu-Pei (TW)

(73) Assignee: Vastview Technology Inc., Hsinchu (TW)

( * ) Notice: Subject to any disclaimer, the term of this patent is extended or adjusted under 35 U.S.C. 154(b) by 505 days.

(21) Appl. No.: 10/799,046

(22) Filed: Mar. 11, 2004

(65) Prior Publication Data

US 2005/0200579 A1 Sep. 15, 2005

(51) Int. Cl.
*G09G 5/00* (2006.01)

(52) U.S. Cl. ..... 345/208; 345/94

(58) Field of Classification Search ..... 345/94, 345/208, 98, 99, 100

See application file for complete search history.

(56) References Cited

U.S. PATENT DOCUMENTS 5,028,916 A * 7/1991 Ichikawa et al. ..... 345/90
6,501,453 B1 * 12/2002 Wong ..... 345/90
6,903,716 B2 * 6/2005 Kawabe et al. ..... 345/99

* cited by examiner

*Primary Examiner*—Richard Hjerpe
*Assistant Examiner*—Kevin M. Nguyen

(57) ABSTRACT

Disclosed is a method for driving pixels of an LCD device, wherein an overlapping area between a data line connected to a data driver and a gate line connected to a gate driver defines a pixel of an LCD device. A first gate driver is selected from the LCD device' at least two gate drivers based on a selection rule. Starting from a line A, the first gate driver displays a part of a picture image by sequentially displaying the image line by line up to a number of lines according to a pre-determined display range. Then a second gate driver based on the selection rule displays a part of an all black image by displaying, from a line B, a number of lines based on a pre-determined display range simultaneously. The line B is separated from the line A by a number of lines according to a pre-determined gap range.

9 Claims, 10 Drawing Sheets

METHOD FOR DRIVING LCD DEVICE

FIELD OF THE INVENTION

The present invention relates to a method of driving a liquid crystal display (LCD) device, and more particularly, to a method of controlling a driver circuit of an LCD device to achieve superior grey-scale response time.

BACKGROUND OF THE INVENTION

As is known to people skilled in related arts, an LCD device has an inherent limitation on its grey-scale response time due to some characteristics of the LCD device. When used as a display for a personal computer, a user cannot perceive a significant difference between an LCD device and a CRT device. However, when used for displaying television programs, the limitation of an LCD device on the grey-scale response time becomes profound as television programs contains almost all moving images. In other words traditional LCD televisions have a significantly inferior display effect compared to CRT televisions.

Conventionally, an LCD device contains a plurality of pixels driven by a driver circuit of the LCD device. The driver circuit contains a plurality of data drivers and gate drivers. The data drivers are connected to data lines and the gate drivers are connected to gate lines of the LCD device. An overlapping area between a data line and a gate line then defines a pixel of the LCD device. In the following a traditional method for controlling the driver circuit of an LCD device is described.

FIGS. 1A and 1B are waveform diagrams showing various control and data signals seen in traditional LCD devices. When a vertical synchronization signal appears, a brand new screen would be displayed on an LCD device line by line in a raster scan pattern. Each scan line has n pixels. FIG. 1A shows waveforms of data and control signals for input a scan line's data into data drivers according to a prior art. As shown in FIG. 1A, when a STH signal becomes active, data for a first scan line's n pixels is input sequentially one pixel a time into data drivers controlled by a horizontal clock signal. When the horizontal clock signal is on a first rising edge, a data for a first pixel is shifted into a data driver, then on a second rising edge, a data for a second pixel is shifted, and following this pattern, data for the n pixels is input into the data drivers. The data for a pixel includes digital data for the pixel's R, G, and B colors. After the data for all n pixels is input, on a rising edge of a conversion signal, the data drivers convert the R, G, and B digital data of all pixels on the first scan line into corresponding driving voltages and apply the voltages on data lines. FIG. 1B shows waveforms of data and control signal for displaying a plurality of scan lines on an LCD device according to a prior art. As shown in FIG. 1B, on a first rising edge of a vertical clock signal, a gate driver will "turn on" a first gate line by asserting a gate driving signal on the first gate line, which in turn allows the driving voltages on the data lines to be applied to all pixels of the first scan line of the LCD device. The first scan line of the LCD device is thereby displayed. Subsequent scan lines will follow a same pattern to be displayed sequentially on the LCD device.

Currently, a number of methods for enhancing a grey-scale response time of an LCD device have already been proposed. Among them a method referred to as Pseudo Impulse Drive (PID) is a more promising one. As implied by its name, the PID method simulates an impulse driving method used by a CRT device to drive an LCD device, so that a display effect of the LCD device would be close to that of a CRT device. There are three commonly known PID methods as described below.

FIGS. 2A–2C are schematic diagrams for methods simulating impulse drive according to prior arts. As shown in FIG. 2A, a picture image is composed by sequentially displaying frames 1, 2, 3, and 4. In a first PID method, all black data frames 11, 12, 13 are interposed between frames 1 and 2, frames 2 and 3, and frames 3 and 4, respectively. At their time of display the foregoing frames' corresponding backlight sources 14–20 are all at light-emitting state. In this way the first PID method achieve a simulation of the impulse drive.

As shown in FIG. 2B, a picture image is composed by sequentially displaying frames 1, 2, 3, 4, 5, 6, and 7. In a second PID method, at their time of display, frames 2, 4, and 6 have corresponding backlight sources 22, 24, and 26 all at turn-off state. On the other hand, frames 1, 3, 5, and 7 at their time of display have corresponding backlight sources 21, 23, 25, and 27 all at light-emitting state. In other words the second PID method utilizes a flashing mode to achieve a simulation of the impulse drive by alternating light-emitting and turn-off backlight sources.

As shown in FIG. 2C, a picture image is composed by sequentially displaying frames 1, 2, 3, and 4. In a third PID method, all black data frames 11, 12, 13 are interposed between frames 1 and 2, frames 2 and 3, and frames 3 and 4, respectively. In addition, at their time of display, frames 11, 12, and 13 have corresponding backlight sources 22, 24, and 26 all at turn-off state, while frames 1, 2, 3, and 4 at their time of display have corresponding backlight sources 21, 23, 25, and 27 all at light-emitting state. In other words the third PID method combines the foregoing two methods to achieve a simulation of the impulse drive.

SUMMARY OF THE INVENTION

A major objective of the present invention is to provide a method of driving an LCD device so as to achieve superior grey-scale response time for the LCD device.

In order to achieve the foregoing objective, the method of the present invention controls a driver circuit of the LCD that contains a plurality of data drivers and at least two gate drivers.

A pixel of the LCD device is defined by an overlapping area of a gate line connected to the gate driver and a data line connected to the data driver. When driving voltages for a line of pixels are placed on the data lines, a gate driver turns on a gate line by asserting a gate driving signal on a gate line so that the driving voltages on the data lines are applied on the line of pixels. A picture image is displayed on the LCD device line by line in this fashion.

According to the method of the present invention, a first gate driver is selected from the at least two gate drivers based on a selection rule. Starting from a line A, the first gate driver displays a part of a picture image by sequentially displaying the image line by line up to a number of lines according to a pre-determined display range. Then a second gate driver based on the selection rule displays a part of an all black image by displaying, from a line B, a number of lines based on a pre-determined display range simultaneously. The line B is separated from the line A by a number of lines according to a pre-determined gap range. To display a line of the all black image the driving voltages have to be of a specific target value.

A further understanding to the advantages and spirits of the present invention can be achieved by the following detailed description and references to the accompanied drawings.

DETAILED DESCRIPTION OF THE INVENTION

Figure 1A:
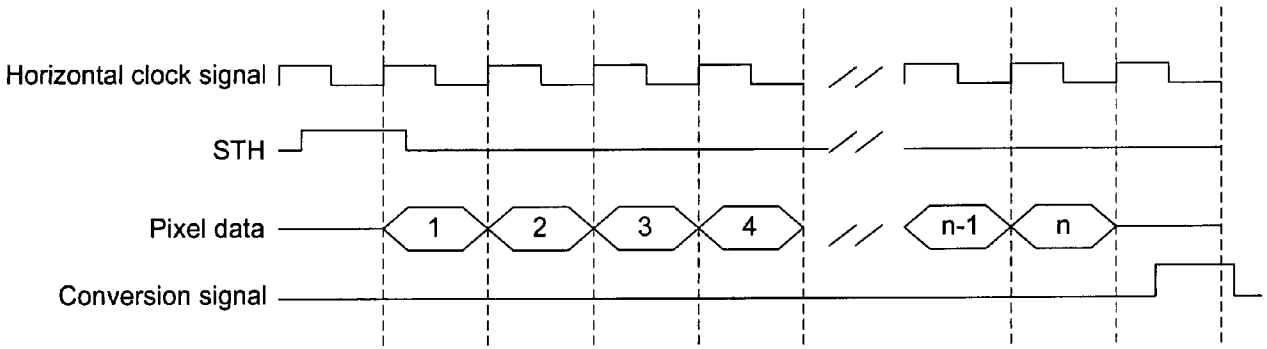
FIGS. 1A and 1B are waveform diagrams showing various control and data signals seen in traditional LCD devices.
Figure 1B:
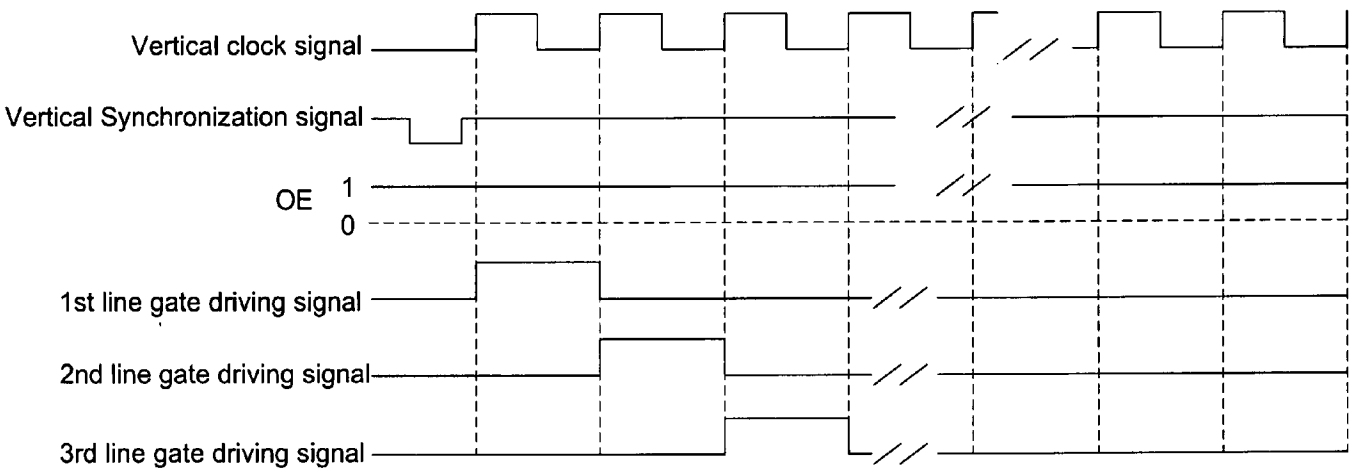
Figure 2A:
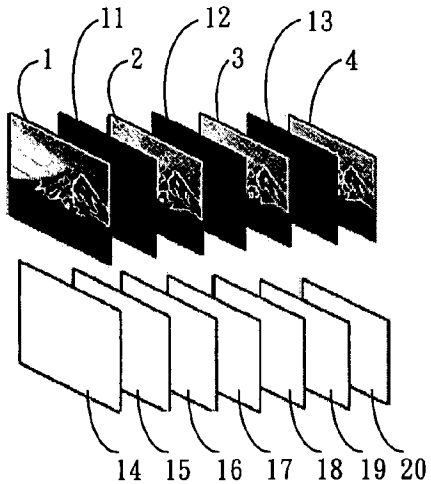
FIGS. 2A–2C are schematic diagrams for methods simulating impulse drive according to prior arts.
Figure 2B:
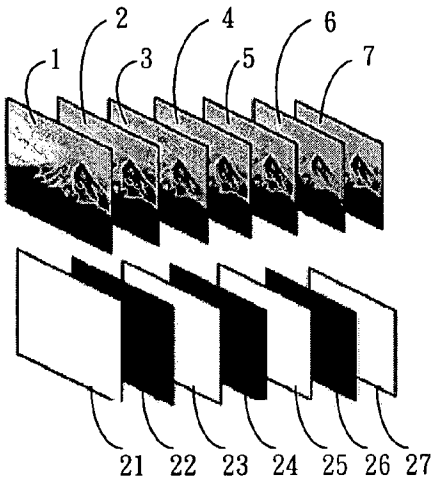
Figure 2C:
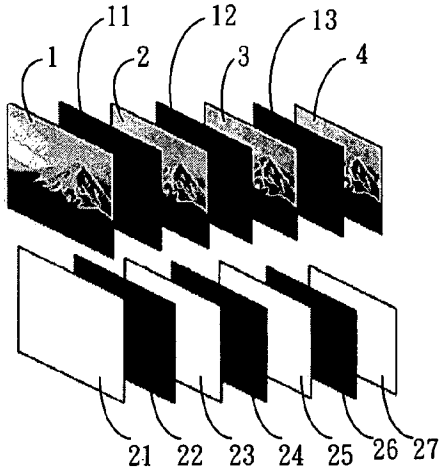
Figure 3:
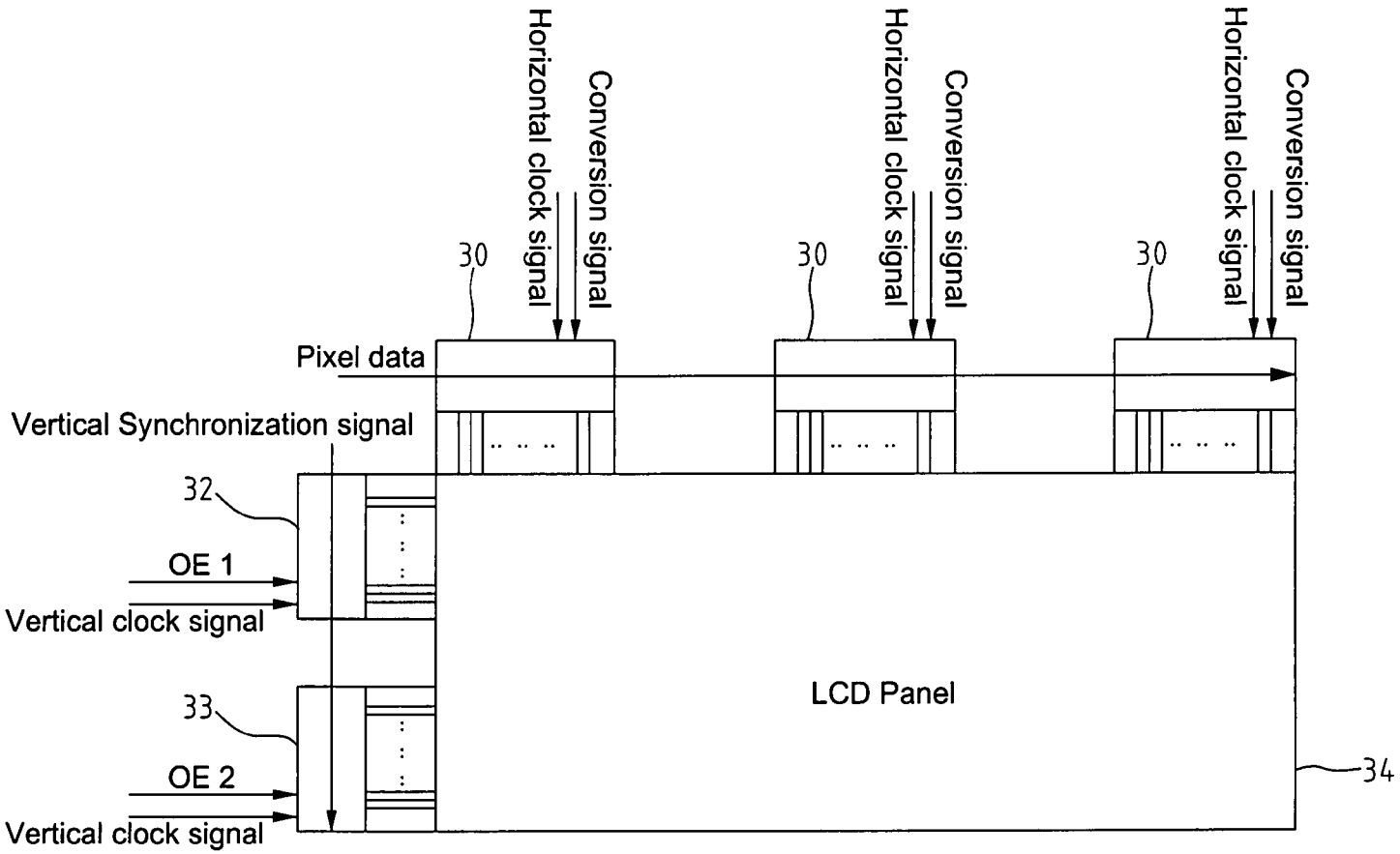
FIG. 3 is a schematic diagram showing a driver circuit of an LCD device controlled by the present invention.

FIG. 3 is a schematic diagram showing a driver circuit of an LCD device controlled by the present invention. As shown in FIG. 3, the driver circuit contains a plurality of data drivers 30 and two gate drivers 32 and 33. The data drivers and gate drivers jointly drive an LCD panel 34. If the LCD panel has a resolution 640×480, the total number of pixels of the LCD panel 34 is 307,200. A total number of data lines connected to the data drivers is 640 and a total number of gate lines connected to the gate drivers is 480. The gate drivers 32 and 33 have two OE signals, OE 1 and OE 2, applied to them respectively. Please note that the two OE signals are not the same as an OE signal used in a driver circuit according to a prior art that is always at an ON(1) state (as shown in FIG. 1B).

If there are totally 480 gate lines, each of the two gate drivers 32 and 33 will connect to 240 gate lines respectively. More particularly, the gate driver 32 connects to the $1^{st}$ to the $240^{th}$ gate lines while the gate driver 33 connects to the $241^{st}$ to the $480^{th}$ gate lines. When a picture image is to be displayed on the LCD panel 34, within each frame time, the gate drivers 32 and 33 sequentially turn on the 480 gate lines so that a frame image is displayed line by line on the LCD panel 34.

In summary, the method of the present invention selects a first gate driver and a second gate driver based on a selection rule. Then by controlling the first and second gate drivers, the present invention turns on the gate lines in a sequence that is different from that of a prior art so as to achieve a faster grey-scale response time. In the following how the present invention applies the OE 1 and OE 2 signals on the gate drivers to turn on the gate lines in a different sequence, and how the first and second gate drivers are determined will be described.

According to the method of the present invention, the first gate driver displays a part of a picture image by sequentially displaying the image line by line starting from a line A up to a number of lines according to a pre-determined display range. Then the second gate driver displays a part of an all black image by displaying, from a line B, a number of lines based on a pre-determined display range simultaneously. The line B is separated from the line A by a number of lines according to a pre-determined gap range. By carefully selecting the pre-determined gap rage to be greater than the number of gate lines connected to a gate driver, the first and second gate drivers would be two separate gate drivers. For example, if the LCD panel 34 has a resolution of 640×480, each of the gate drivers 32 and 33 will connect to 240 gate lines respectively. And if the pre-determined gap range is equal to or greater than 240, for example, the gate driver 32 will display a part of a picture image while the gate driver 33 will display a part of an all black image. A driver circuit to a conventional LCD device has to be modified so that the OE 1 and OE 2 signal can be used to control the gate drivers 32 and 33 to alternate their operations.

Based on the foregoing description, a selection rule of the present invention is as follows. When driving voltages asserted by the data drivers 30 correspond to a part of a picture image, a gate driver activated to display that part of image is referred to as the first gate driver. When driving voltages asserted by the data drivers 30 are of a specific target value corresponding to a line of all black images, a gate driver activated to display that part of the all black image is referred to as the second gate driver.

Figure 4A:
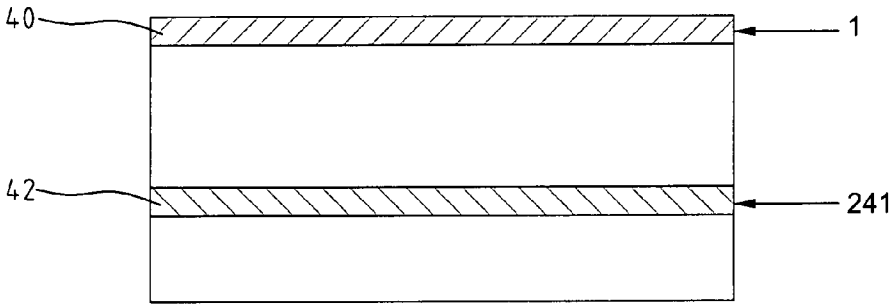
FIGS. 4A–4C are schematic diagrams showing a scan line display sequence of the present invention whose pre-determined display range is 1.
Figure 4B:
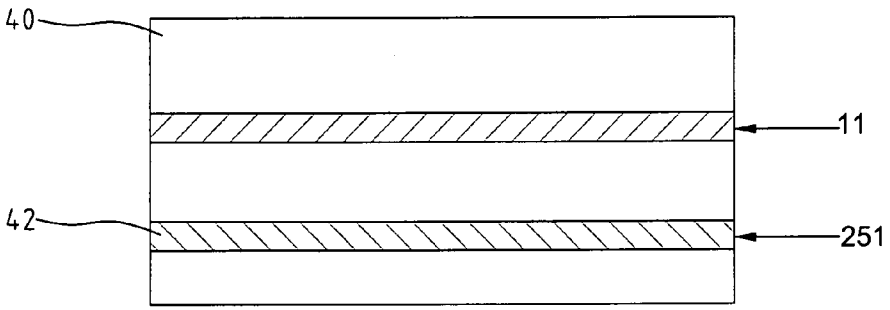
Figure 4C:
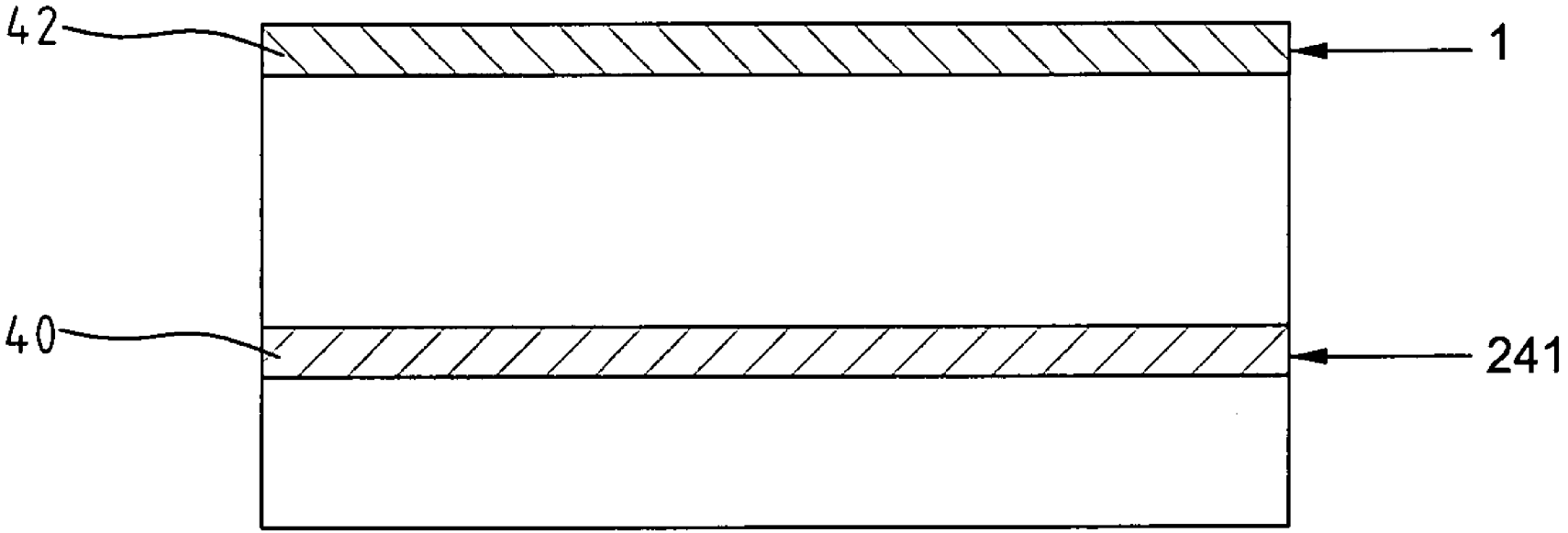

FIGS. 4A–4C are schematic diagrams showing a scan line display sequence of the present invention. As shown in FIGS. 4A–4C, the pre-determined display rage is 1. Line A is the first line. And the pre-determined gap range is 240. As shown in FIG. 4A, the data drivers assert driving voltages corresponding to a line of a picture image 40. Based on the selection rule, the gate driver 32 is the first gate driver and starting from the first gate line the gate driver 32 displays up to one line of the image 40. The gate driver 33 is the second gate driver and starting from the $241^{st}$ gate line the gate driver 33 displays up to one line of an all black image 42.

The first and second gate drivers alternate their operations as described above. As shown in FIG. 4B, after the first gate driver turns on the $11^{th}$ gate line and the $11^{th}$ scan line of the picture image is thereby displayed on the LCD panel 34, the second gate driver turns on the $251^{st}$ gate line so that the $251^{st}$ scan line of the black image is displayed. After the gate driver 32 reaches the very last gate line connected, i.e. the $240^{th}$ gate line, and when the $241^{st}$ scan line of the picture image is to be display, as the corresponding gate line is connected to the gate driver 33, the gate driver now becomes the first gate driver. And based on the selection rule, the gate driver 32 now becomes the second gate driver.

As shown in FIG. 4C, the first gate driver (now the gate driver 33) turns on the display of the $241^{st}$ line of the picture image. Then the second gate driver (now the gate driver 32) turns on the display of the $1^{st}$ line of the all black image, as the $1^{st}$ scan line is 240 lines away from the $241^{st}$ scan line. Please note that the $241^{st}$ scan line of the LCD panel 34 displays a line of the all black image earlier as shown in FIG. 4A. Thereby a same effect to the impulse drive used in CRT devices is achieved by the present invention and the LCD panel 34 therefore has a superior grey-scale response time. In the following various data and control signals used to achieve the foregoing display sequence are described.

Figure 5:
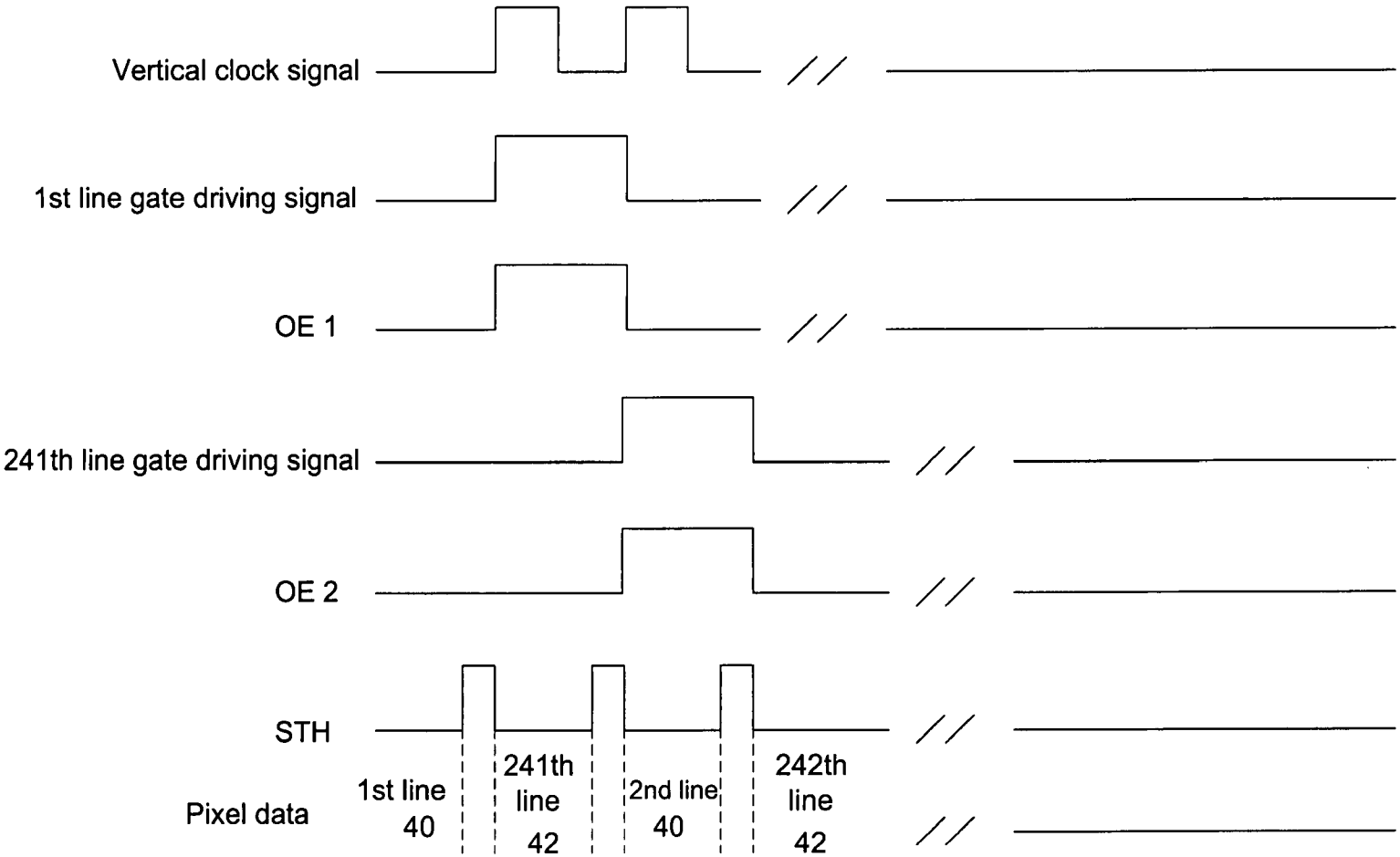
FIG. 5 is a waveform diagram showing various data and control signals according the present invention whose pre-determined display range is 1.

FIG. 5 is a waveform diagram showing various data and control signals according the present invention. As shown in FIG. 5, the pre-determined display range is 1, line A is the first line, and the pre-determined gap range is 240. Driving voltages asserted by the data driver 30 are in the following sequence. First, driving voltages for displaying the $1^{st}$ line of image 40 is asserted, then driving voltages for displaying the $241^{st}$ line of the all black image 42 is asserted, then driving voltages for displaying the $2^{nd}$ line of image 40 is asserted, then driving voltages for displaying the $242^{nd}$ line of the all black image 42 is asserted, and so on. During a first vertical clock period, OE 1 is at an active state and a gate driving signal is asserted on the $1^{st}$ gate line. The $1^{st}$ line of image 40 is thereby displayed on the $1^{st}$ scan line of the LCD panel 34. Similarly, during a second vertical clock period, OE 2 is at an active state and a gate driving signal is asserted on the $241^{st}$ gate line. The $241^{st}$ line of the all black image 42 is thereby displayed on the $241^{st}$ scan line of the LCD panel 34.

Figure 6:
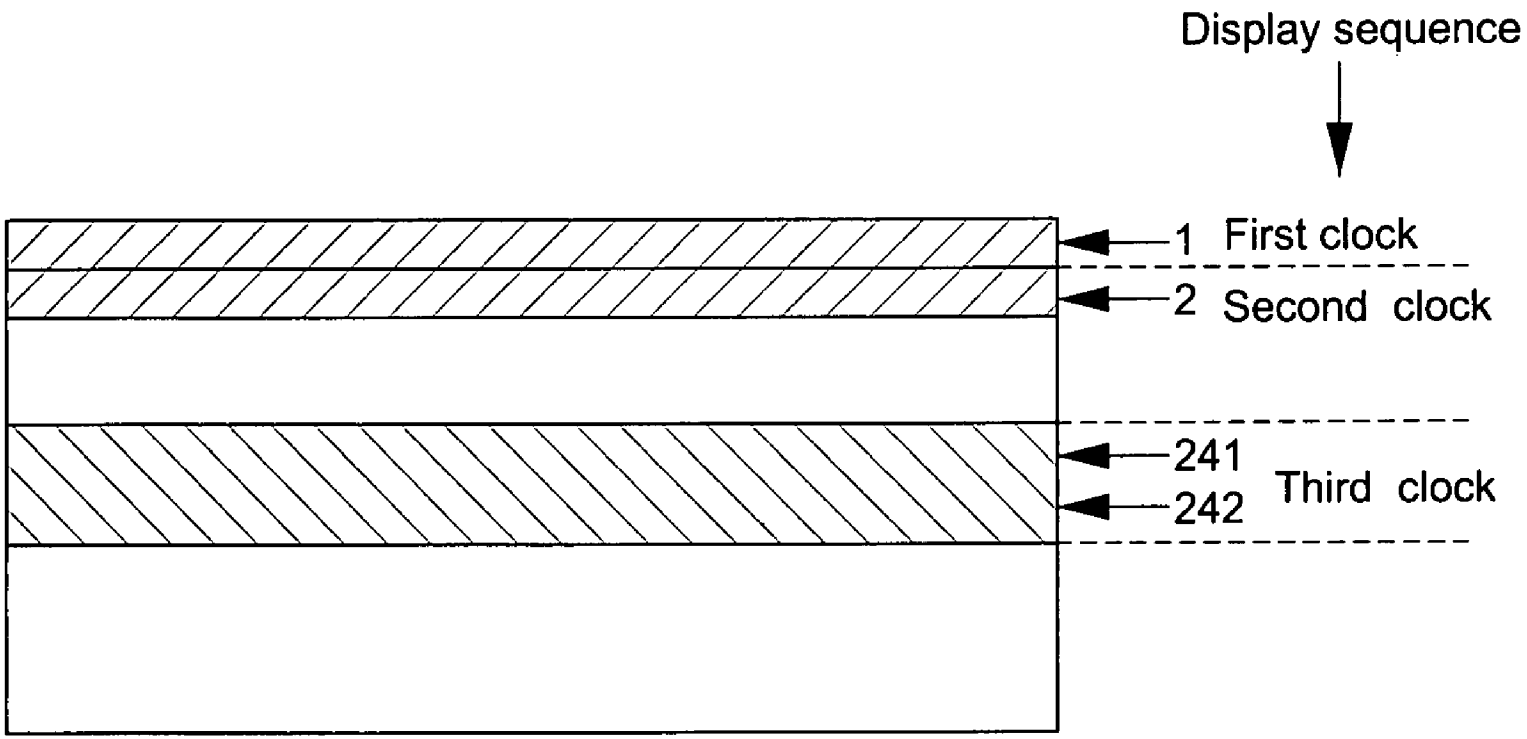
FIG. 6 is a schematic diagram showing a scan line display sequence of the present invention whose pre-determined display range is 2.

FIG. 6 is a schematic diagram showing another scan line display sequence of the present invention. As shown in FIG. 6, the pre-determined display range is 2, line A is the first line, and the pre-determined gap range is 240. The first gate driver turns on the $1^{st}$ gate line and then the $2^{nd}$ gate line sequentially. Up to two lines of the picture image 40 are thereby displayed on the first two scan lines of the LCD panel 34. The second gate driver then turns on the $241^{st}$ and $242^{nd}$ gate lines simultaneously so that up to two lines of the all black image are displayed on the $241^{st}$ and $242^{nd}$ scan lines of the LCD panel 34. Therefore a display sequence of the scan lines is as follows: the $1^{st}$ scan line, the $2^{nd}$ scan line, and then the $241^{st}$ and $242^{nd}$ two scan lines together.

Figure 7:
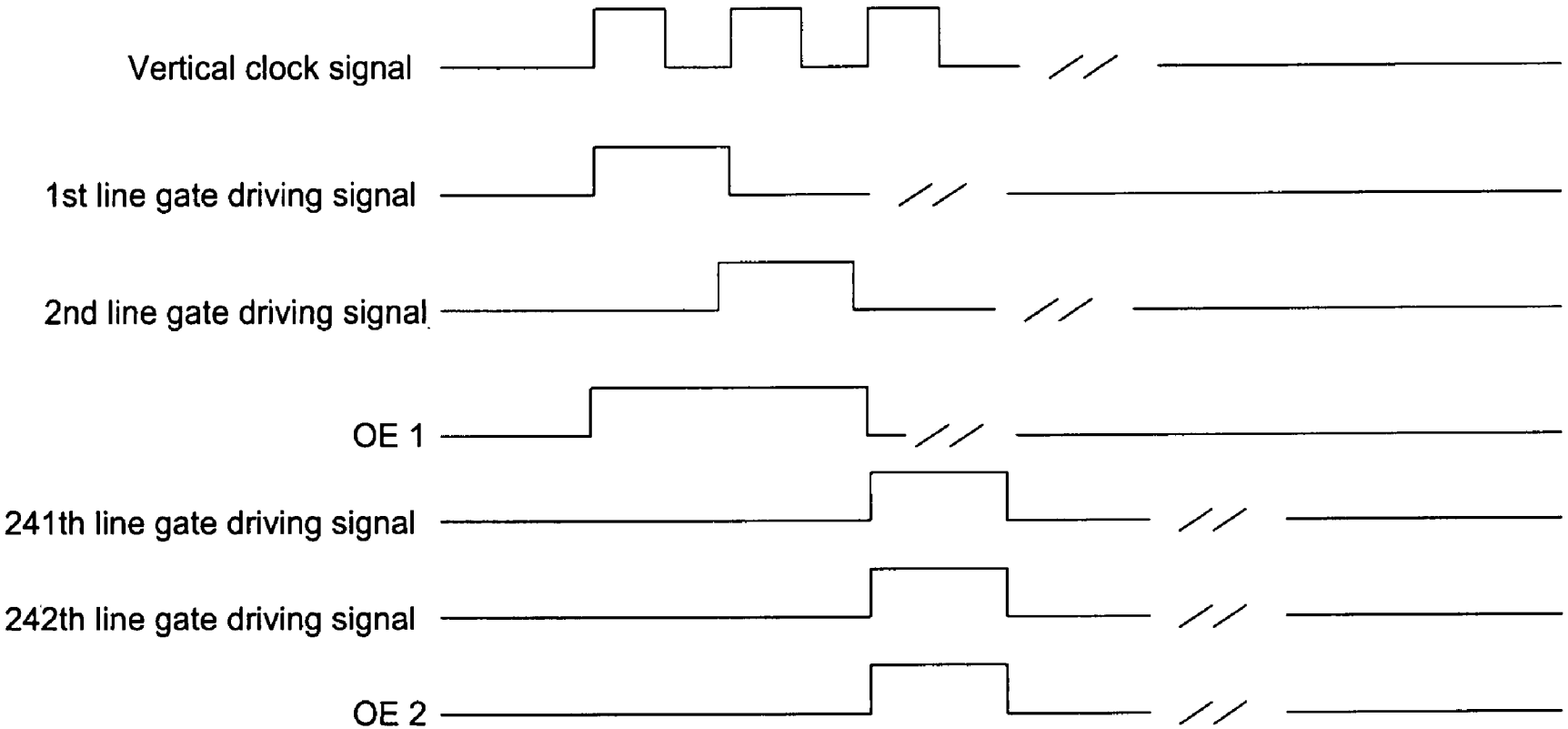
FIG. 7 is a waveform diagram showing various data and control signals according the present invention whose pre-determined display range is 2.

FIG. 7 is another waveform diagram showing various data and control signals according the present invention. As shown in FIG. 7, the pre-determined display range is 2, line A is the first line, and the pre-determined gap range is 240. Driving voltages asserted by the data driver 30 are in the following sequence. First, driving voltages for displaying the $1^{st}$ line of image 40 is asserted, then driving voltages for displaying the $2^{nd}$ line of image 40 is asserted, then driving voltages for displaying the $241^{st}$ line of the all black image 42 is asserted, then driving voltages for displaying the $242^{nd}$ line of the all black image 42 is asserted, and so on. During a first vertical clock period, OE 1 is at an active state and a gate driving signal is asserted on the $1^{st}$ gate line. The $1^{st}$ line of image 40 is thereby displayed on the $1^{st}$ scan line of the LCD panel 34. During a second vertical clock period, OE 1 remains at the active state. A gate driving signal is then asserted on the $2^{nd}$ gate line. The $2^{nd}$ line of image 40 is thereby displayed on the $2^{nd}$ scan line of the LCD panel 34. On the other hand, when OE 2 is at an active state, gate driving signals are asserted on the $241^{st}$ and $242^{nd}$ gate lines simultaneously. The $241^{st}$ and $242^{nd}$ lines of the all black image 42 are thereby displayed on the $241^{st}$ and $242^{nd}$ scan lines of the LCD panel 34.

By a comparison between FIG. 5 and FIG. 7, it can be seen from FIG. 7 that when the pre-determined display range is 2 a display of the $1^{st}$, $2^{nd}$, $241^{st}$, and $242^{nd}$ lines can be accomplished within three vertical clock periods. In contrast, as seen from FIG. 5 when the pre-determined display range is 1, a display of the $1^{st}$, $2^{nd}$, $241^{st}$, and $242^{nd}$ lines would require four vertical clock periods. Based on the foregoing description, theoretically, increasing the pre-determined display range could reduce vertical clock periods required to display a same number of scan lines. However, the pre-determined display range cannot be greater than a gate driver's number of connected gate lines. And when the two numbers are identical, vertical clock periods required would be close to that of an LCD according to a prior art.

Figure 8:
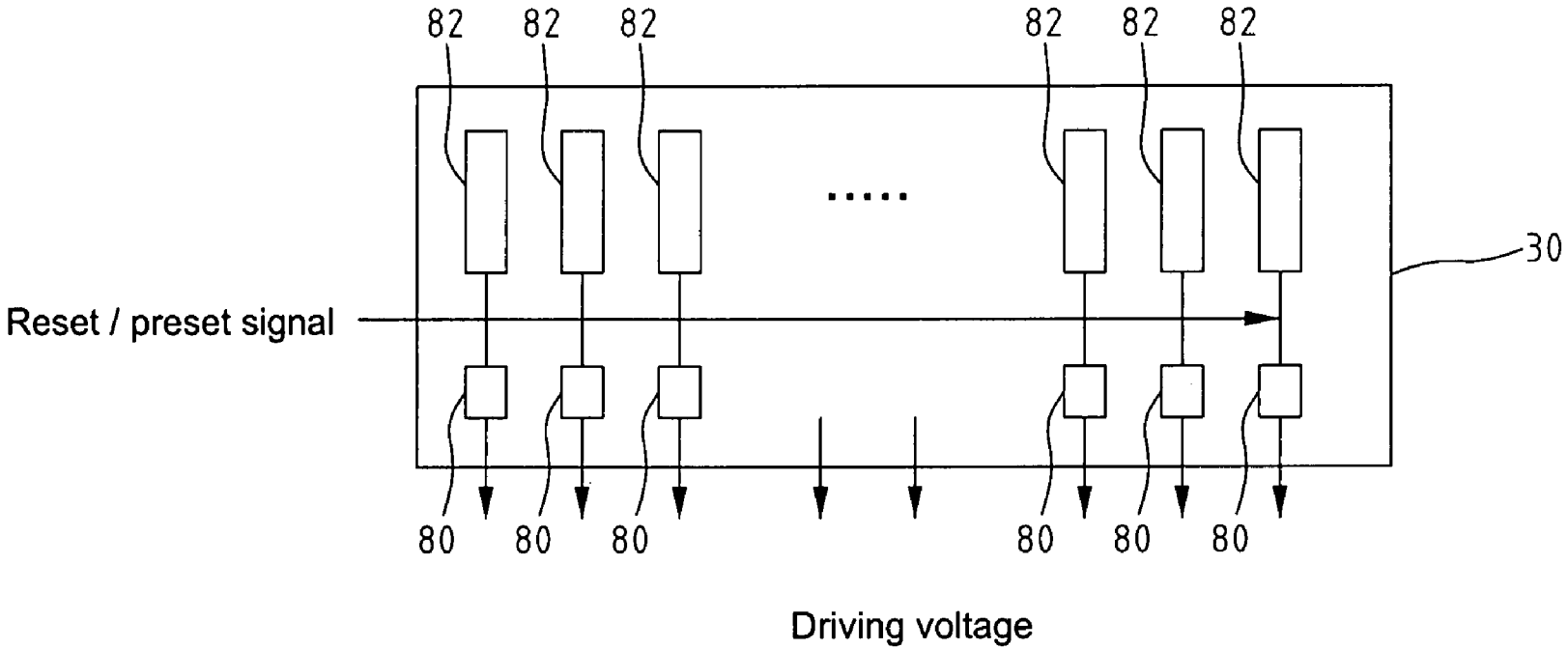
FIG. 8 is a schematic diagram showing an inner structure of a data driver with a reset or preset signal line.

FIG. 8 is a schematic diagram showing an inner structure of a data driver with a reset or preset signal line. As shown in FIG. 8, a data driver 30 contains a plurality of data registers 82 and each data register 82 has a corresponding digital-to-analog converter (DAC) 80. A pixel's data is shifted into a data register 82 and then converted by a DAC 80 into a driving voltage onto a data line. To output driving voltages with a target value, data registers 82 have to be filled in with some specific data and a reset/preset signal line is therefore introduced for this task. When a data driver is required to output driving voltages with the target value, a preset signal could be asserted on the preset signal line so that the data registers 82 are filled with the specific data. Or a reset signal could be asserted on he reset signal line so that the data registers 82 are reset with the specific data. In either ways data drivers 30 are able to output driving voltages with the target value.

With the reset or preset signal line, data drivers are not required to input any pixel data in order to output driving voltages with the target value. As shown in FIG. 5, a vertical clock period is required to display a line of the all black image. On the other hand, the reset or preset signal line allows data drivers to continue output driving voltages with the target value without spending time to input the specific pixel data and therefore, as shown in FIG. 7, a vertical clock period can display a plurality of lines of the all black image and thereby reduces a grey-scale response time of the LCD panel 34. However, as shown in FIG. 8, DACs are still required to convert the specific pixel data reset or preset in the data registers 82 into driving voltages with the target value.

Figure 9:
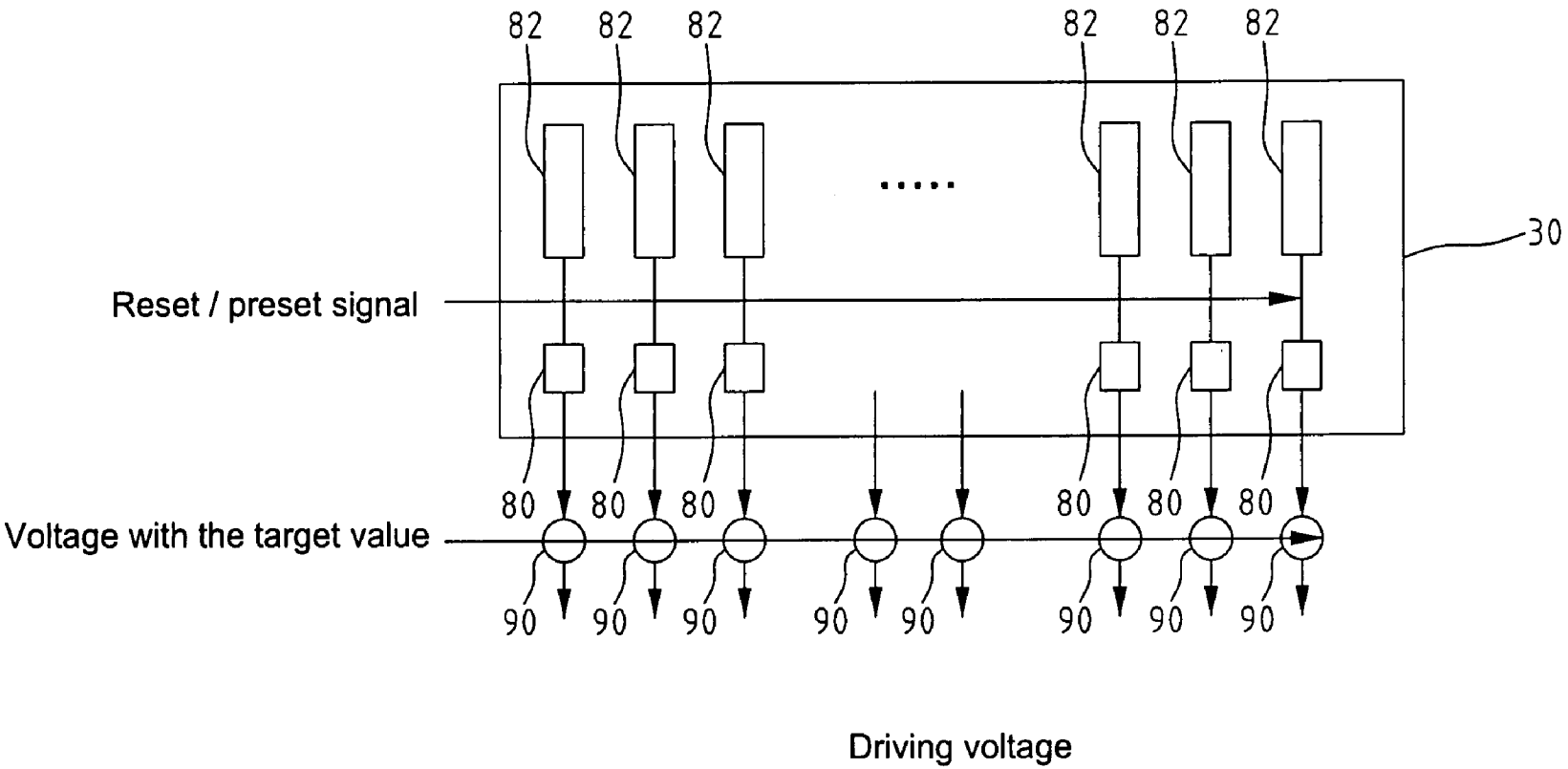
FIG. 9 is a schematic diagram showing an inner structure of a data driver and a plurality of switches.

FIG. 9 is a schematic diagram showing an inner structure of a data driver and a plurality of switches. As shown in FIG. 9, a plurality of switches 90 are placed between DACs 80 and their corresponding data lines. A switch 90 has two inputs. One is from the output of a DAC 80 inside the data driver 30. The other one is a separate signal line carrying a voltage with the target value. The switch 90 can select one of the inputs to be placed on a data line connected to the switch 90. If a data driver outputs driving voltages corresponding to a part of a picture image, the switch 90 allows that driving voltage to be placed on a data line. On the other hand, in order to display a line of the all black image, the switch 90 allows the voltage with the target value on the separate signal line to be placed on a data line. Please note that the switches 90 can be inside or outside the data driver 30.

The data drivers 30 in both FIGS. 8 and 9 can achieve a reduction of a grey-scale response time of an LCD device. An advantage of the data driver 30 as shown in FIG. 9 is that a digital-to-analog conversion by the DAC 80 is omitted.

The foregoing detailed description to the preferred embodiments of the present invention are exemplary and explanatory, and are not intended to provide any restriction to the present invention as disclosed above. On the contrary, it is intended that various equivalent modifications and variations to embodiments of the present invention should be considered to be still within the spirit and scope of the present invention as claimed.

What is claimed is:

1. A method of controlling a driver circuit of an LCD device, wherein the driver circuit comprises a plurality of data drivers and at least two gate drivers, the data drivers are connected to data lines, the gate drivers are connected to gate lines, an overlapping area of a data line and a gate line defines a pixel of the LCD device, the data drivers applies driving voltages corresponding to a line of picture image onto a scan line of pixels through the data lines, and the gate drivers turn on the gate lines by asserting gate driving signals onto the gate lines so that the scan lines of pixels are displayed, comprising:

selecting a first gate driver from the at least two gate drivers based on a selection rule, wherein the first gate driver sequentially turns on a pre-determined range of gate lines starting from a gate line A and, thereby, a part of a picture image is displayed on the LCD device; and selecting a second gate driver from the at least two gate drivers based on the selection rule, wherein the second gate driver simultaneously turns on the pre-determined range of gate lines starting from a gate line B that is separated from the gate line A by a pre-determined gap of gate lines and, thereby, a part of a special image whose corresponding driving voltages are of a specific target value.

2. The method of controlling a driver circuit of an LCD device according to claim 1, wherein the selection rule determines a gate driver as the first gate driver if driving voltages output by the data drivers correspond to a part of a picture image and the gate driver is used to display the part of a picture image represented by the driving voltages.

3. The method of controlling a driver circuit of an LCD device according to claim 1, wherein the selection rule determines a gate driver as the second gate driver if driving voltages output by the data drivers are of a specific target value and correspond to a part of a specific image and the gate driver is used to display the part of a specific image represented by the driving voltages of the target value.

4. The method of controlling a driver circuit of an LCD device according to claim 1, wherein the gate lines are distributed among the gate drivers so that each of the gate drivers are connected to a fixed number of gate lines.

5. The method of controlling a driver circuit of an LCD device according to claim 4, wherein the pre-determined range of gate lines is equal or greater the said fixed number of gate lines.

6. The method of controlling a driver circuit of an LCD device according to claim 1, wherein the data drivers can receive a reset signal from a reset line and, when that happens, all data registers of the data drivers are reset to have a specific content so that the driving voltages output by the data drivers are of the target value.

7. The method of controlling a driver circuit of an LCD device according to claim 1, wherein the data drivers can receive a preset signal from a preset line and, when that happens, all data registers of the data drivers are preset to have a specific content so that the driving voltages output by the data drivers are of the target value.

8. The method of controlling a driver circuit of an LCD device according to claim 1, wherein a switch can be placed between a data line and a data driver and, when a driving voltage output from a digital-to-analog converter inside the data driver corresponds to a part of a picture image, the switch allows the driving voltage to pass onto the data line.

9. The method of controlling a driver circuit of an LCD device according to claim 1, wherein a switch can be placed between a data line and a data driver and, when a driving voltage of the target value is required on the data line, the switch takes the driving voltage directly from a target value line and pass the voltage onto the data line, instead of taking an output from the data driver.

* * * * *